United States Patent [19]

Ito

[11] Patent Number: 4,947,434

[45] Date of Patent: Aug. 7, 1990

[54] ELECTRONIC ATTENUATOR

[75] Inventor: Hiroyuki Ito, Sakai, Japan

[73] Assignee: Daikin Industries, Ltd., Osaka, Japan

[21] Appl. No.: 329,637

[22] Filed: Mar. 28, 1989

[30] Foreign Application Priority Data

Mar. 28, 1988 [JP] Japan ..... 63-074195

[51] Int. Cl.[5] ..... G10K 11/16

[52] U.S. Cl. ..... 381/71

[58] Field of Search ..... 381/190, 191, 71, 94

[56] References Cited

U.S. PATENT DOCUMENTS 4,367,426 1/1983 Kumada et al. ..... 310/322
4,665,549 5/1987 Eriksson et al. ..... 381/71
4,807,294 2/1989 Iwata et al. ..... 381/190

FOREIGN PATENT DOCUMENTS 57-94799 6/1982 Japan .
61-109495 5/1986 Japan .
61-296392 12/1986 Japan .

*Primary Examiner*—Forester W. Isen
*Attorney, Agent, or Firm*—Wenderoth, Lind & Ponack

[57] ABSTRACT

An electronic attenuator uses a speaker which is sheet-like in shape and is made of a piezoelectric material for generating a reversal sound. The attenuator uses a microphone installed in a noise transmittable space for detecting a noise and uses a control circuit for generating a reversal sound signal having a reverse phase and same sound pressure in relation to a noise on the basis of the noise signal detected by the microphone. The speaker receives the reversal sound signal from the control circuit and emits the reversal sound to the noise transmittable space so as to cancel the noise signal detected by the microphone. This electronic attenuator solves the problems of space required for the installation of a speaker, and reduces manufacturing costs and the like.

3 Claims, 6 Drawing Sheets

ELECTRONIC ATTENUATOR

BACKGROUND OF THE INVENTION

1. Field of the Invention

This invention relates to an electronic attenuator for attenuating a noise by making a reversal sound act on the noise and by a mutual interference action of both.

2. Description of the Prior Art

Conventionally, it has been known to attenuate a noise actively by making a reversal sound of reverse phase and same sound pressure act on the noise and by mutual interference of the noise and the reversal sound. Especially in recent years, with the progress of the electronic device, signal conditioning techique, etc., it has been suggested, for example, to generate a reversal sound which is faithful to a noise and to attenuate even an unsteady-state noise by generating a reversal sound in immediate response to variations of noise. Japanese Patent Application Laying Open Publication Gazette No. 61-296329 (title of the invention: electronic attenuating system) is an example.

A sound attenuating device of this kind uses a speaker for generating a reversal sound, for example, a speaker is provided at a circumferential wall of a duct connecting to a noise source and reversal sounds emitted from the speaker are caused to interfere with noises in the duct. Such a speaker is generally of cone type but is required to be of a certain size so as to generate a sound pressure of almost the same extent as a noise and also is required to have fairly outstanding characteristics so as to generate reversal sounds faithful to noises.

In the case where a conventional sound attenuator is applied to the sound attenuating for a device of small scale, such as an air conditioner for use at a shop, a home or the like, it is inevitable that a speaker occupies a large space and accordingly a noise source device is larger in size or in the case where a speaker is placed at the optimum position, a large protrusion is formed at a case body. Thus, application of it to the device of small scale itself was impossible and also was difficult from the cost point of view.

In the case of attenuating a specific noise source in a duct or a case body which is smaller than a size of certain extent, it is impossible to secure space for placing a speaker and accordingly the application of a sound attenuator is limited to a large duct an a large device.

SUMMARY OF THE INVENTION

The present invention has for its object to solve the above problematical points and to provide an electronic attenuator of high universality which is applicable even to a device of small scale. For this purpose, it is so designed that a speaker can be installed at a desired position, irrespective of the shape of a device in which a speaker is installed and the shape of space.

Another object of the present invention is to provide electronic attenuators in which a speaker can be installed at an optium position at all times and which is applicable at a moderate cost.

In the present invention, a reversal sound is generated by a speaker of sheet-like shape made of piezoelectric material so as to solve such problems as space for installing a speaker, manufacturing costs, etc.

More concretely, an electronic attenuator is composed of a microphone for detecting a noise, a control circuit for generating a reversal sound having a reverse phase and same sound pressure in relation to the noise on the basis of a noise signal detected by the microphone and a speaker for emitting the reversal sound in the noise transmittable space, and the speaker disposed so as to surround the noise transmittable space and is in sheet-like shape with a driver made of a piezoelectric material.

In the case where the noise transmittable space is in tubular shape, it is desirable to bend a speaker in cylindrical shape. As to the driver of the speaker, such a driver which is made of transparent high molecular piezoelectric material, with a transparent conductive film fixed to one side thereof, is desirable.

Since a speaker is in sheet-like shape in the present invention, a speaker can be installed as desired, irrespective of the shapes of a device and space in which it is installed. Therefore, an attenuator according to the present invention is applicable to a device of small scale, as well as the apparatus of large size and also a speaker can be installed at an optimum position. As compared with a conventional speaker, since a speaker in the present invention is in sheet-like shape which is simple in construction an is easy to mass-produce, an attenuator according to the present invention can be produced at a cheaper cost and is applicable even to a device of small scale.

In the case where the noise transmittable space is in tubular shape, a speaker in cylindrical shape can be easily installed in a tube of small bore by curving the speaker in cylindrical shape an a reversal sound can be emitted in such a state as enclosing the space in the tube and therefore, as compared with the conventional speaker which emits a reversal sound in the state of point sound source, the speaker can make a reversal sound and a noise interfere with each other efficiently and an interference area can be made larger by the cylindrical length of the speaker, with resultant improvements of sound attenuating effect as a whole.

By forming the driver of the speaker with a transparent conductive film, the speaker is provided with the the transparent driver and therefore a sense of incompatibility caused by installation of the speaker can be eliminated in the case where it is applied to the noise transmittable space for which facing is a problem.

DESCRIPTION OF THE DRAWINGS

FIG. 1 and FIG. 2 show respectively an embodiment of the present invention, of which FIG. 1 is a theory explanatory drawing showing an outline of an electronic attenuator and FIG. 2 is a perspective view of a speaker;

FIG. 4(A) and FIG. 4(B) are modified examples of a speaker installation condition, of which FIG. 4(A) is a plan view of the interior of an outdoor machine of an air conditioner and FIG. 4(B) is a perspective view of an indoor machine;

DETAILED DESCRIPTION OF THE PREFERRED EMBODIMENTS.

Figure 1:
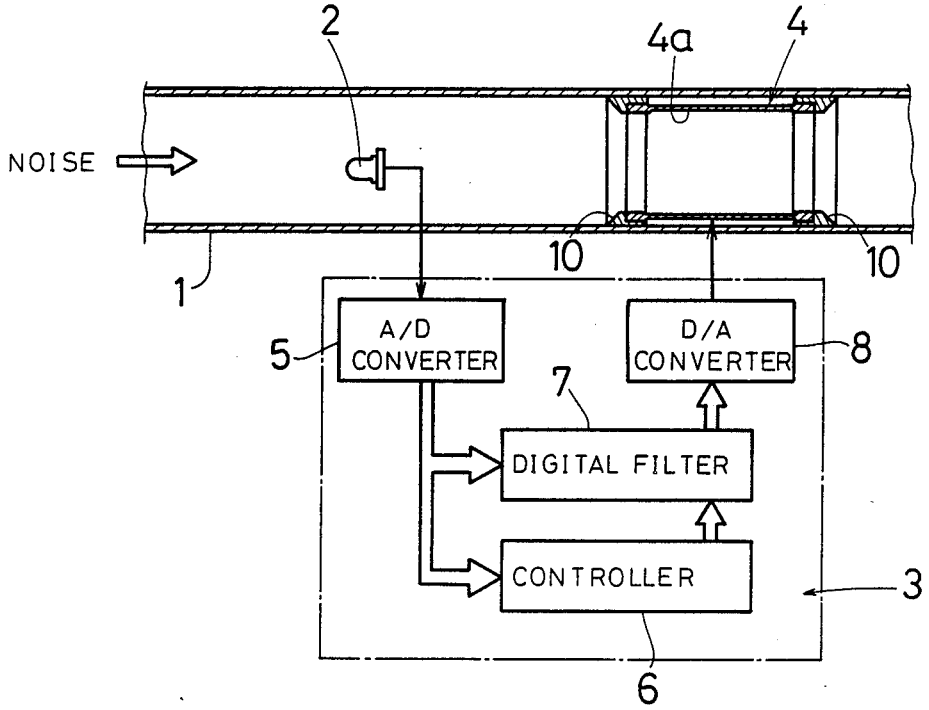
Figure 2:
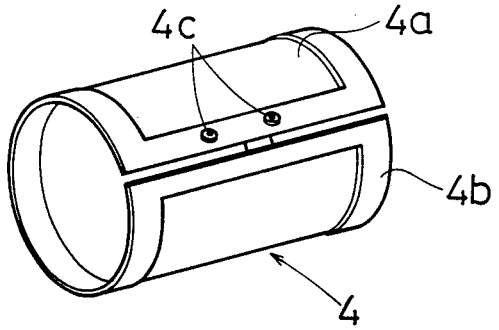

FIG. 1 and FIG. 2 show an embodiment to which an attenuator according to the present invention is applied to a ventilating duct of an air conditioner.

In FIG. 1, an electronic attenuator comprises a microphone 2 for detecting a noise installed in a ventilating duct 1 which is the noise transmittable space, a control circuit 3 which generates a signal of reversal sound of reverse phase and same sound pressure in relation to a noise on the basis of a noise signal detected by the microphone 2 and a speaker 4 which emits a reversal sound upon receipt of a reversal sound signal from the control circuit 3. The microphone 2 is of unidirectional type and is installed facing a noise source and nearer to it than the speaker 4.

Figure 3:
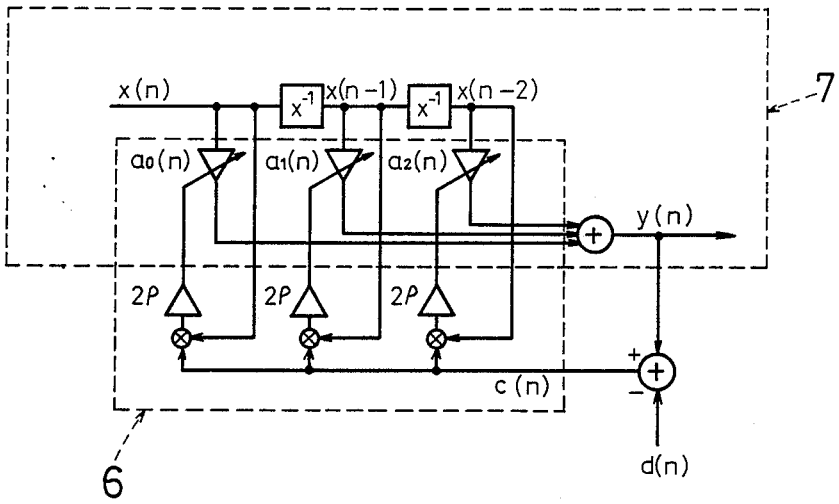
FIG. 3 is a concrete circuit diagram of a controller and a digital filter.

The control circuit 3 comprises an A/D converter 5 which A/D converts a noise signal current obtained by the microphone 2, a controller 6, and adaptive digital filter 7 and a D/A converter 8 which D/A converts an output signal of the digital filter 7 and outputs to the speaker 4. The digital filter 7 takes in a noise signal from the microphone 2 inputted via the A/D converter 5 and generates, on the basis of a control instruction given by the controller 6, a reversal sound signal having the specified amplitude characteristic and phase characteristic which correspond to the noise signal. The controller 6 gives, on the basis of the above noise signal, the digital filter 7 a control parameter corresponding to the noise and also carries out an adaptation control by amending the control parameter in response to the variations of noise. The control parameter is outputted as it is added with conversion characteristic of the microphone 2, the speaker 4, etc. in a non-noise state. Also, the controller 6 carries out a treatment of outputting a test signal to each part of the circuit for judgement. An example of a concrete circuit of the controller 6 an the digital filter 7 is shown in FIG. 3.

The speaker 4 comprises a speaker in sheet-like shape with the driver 4*a* made of high molecular piezolectric material, such as polyvinyl defluoride, and is arranged in the duct 1 in tubularly rounded shape. In FIG. 2, the speaker 4 comprises the driver 4*a* and a frame 4*b* which supports a circumferential edge of the driver 4*a*. The speaker 4 emits a reversal sound, on the basis of a reversal sound signal inputted via a terminal end 4*c* provided at the frame 4*b*, toward the inner surface of a tube. In the duct 1, the speaker 4 is fixed through the medium of a damper 10 and is supported in such a fashion that vibration of the speaker 4 is not transmitted to the duct 1.

According to the electronic attenuator composed as above, even if a bore of the ventilating duct 1 is small the speaker 4 can be easily installed in the duct 1 and moreover, the speaker 4 can be installed without impeding a flow of harmonic air moving in the duct. Also, since it is possible to emit a reversal sound in such a state of enclosing perfectly space in the duct, as compared with the conventional speaker which cannot but emit a reversal sound in a point sound source state, the attenuator of the present invention can make the reversal sound and the noise interfere with each other effectively and also makes it possible to enlarge the interference area by a tubular length of the speaker. Thus, attenuating effect is improved as a whole.

FIG. 4(A) and FIG. 4(B) show respectively a modified example of the state in which the speaker 4 is installed.

Figure 4:
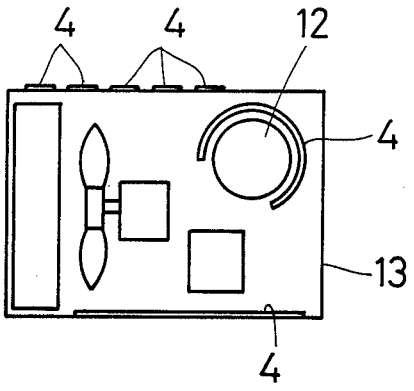
Figure 4:
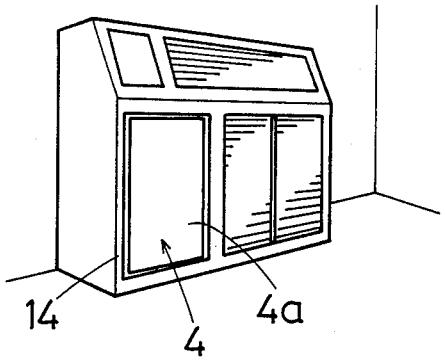

FIG. 4 (A) shows the case where an outdoor machine of an air conditioner is made an object of installation. In the case where a noise of a compressor 12 is made a problem, for example, three cases are shown at the same time, namely, (1) the case where an outer surface is enclosed with the speaker 4 which is bent arcurately, (2) the case where the speaker 4 is installed along an inner surface of a case body 13 and (3) the case where a plurality of small size speakers 4 is installed at an outer surface of the case body 13. Thus the speaker 4 can be installed in varying shapes, sizes, etc. according to the shape of an apparatus which is a noise source, size of space, etc.

FIG. 4(B) shows the case where the speaker 4 is mounted on the outer surface of an apparatus in which facing becomes a problem. In this case, the speaker 4 is formed by the transparent driver 4*a* so as to eliminate a sense of incompatibility to be caused by installation of a speaker at the outer surface of a case body 14. Copolymer of vinylidene cyanide and vinyl acetate is used as transparent high molecular piezoelectric material for the driver 4*a* and transparent conductive film layer is fastened to the surface of the driver 4*a*. The conductive film layer is formed by mixing up polyvinyl alcohol and a small amount of ferric chloride solution, by coating the above copolymer with a mixed liquid thus obtained and after drying by making the coating contact polyvinyl steam.

FIG. 5 and FIGS. 6*a*–6*d* show respectively modified examples of an attenuating method.

Figure 5:
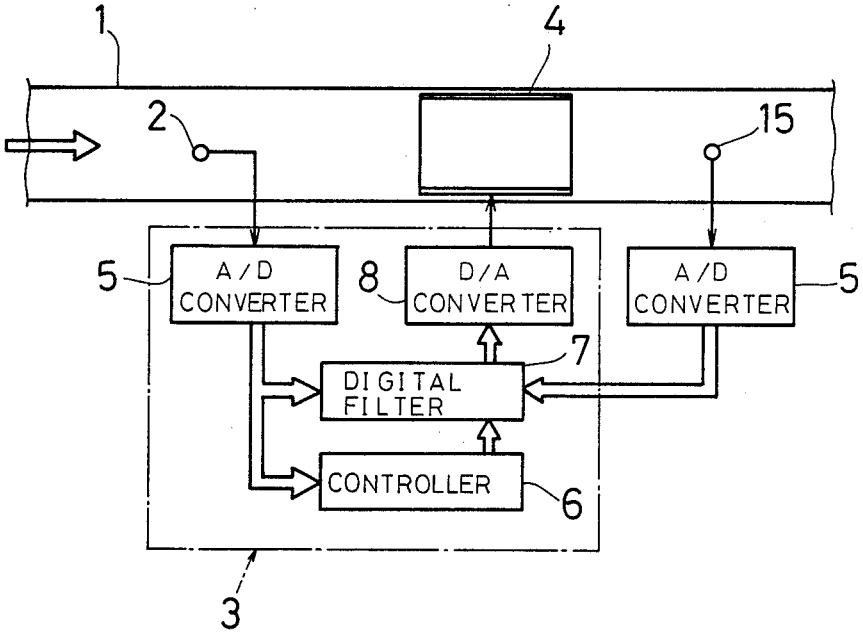
FIG. 5, FIG. 6(A) through to FIG. 6(D) are theory explanatory drawings, each showing a modified example of an attenuating system.

FIG. 5 shows an attenuating method by which control is carried out by the controller 6 so that an output signal of an interference sound to be detected by the microphone 15 is made the lowest value, for which the microphone 15 for appraising is added to the attenuator explained above.

Figure 6A:
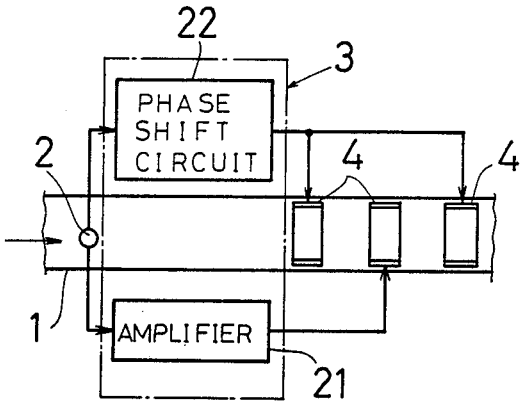
Figure 6B:
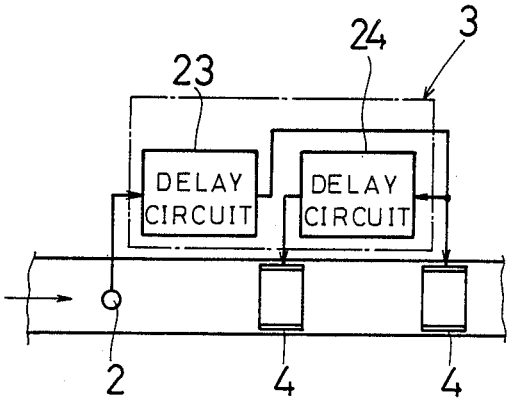
Figure 6C:
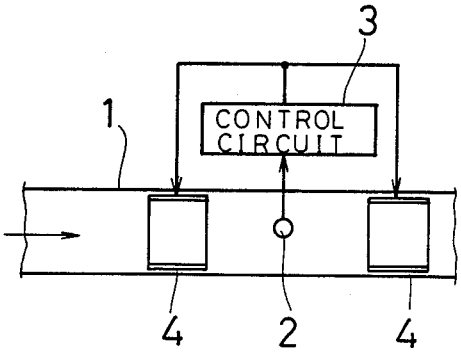
Figure 6D:
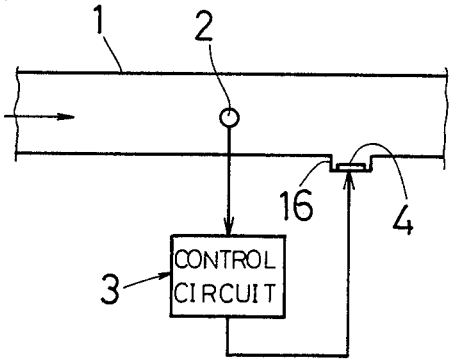

FIG. 6(A), FIG. 6(B) and FIG. 6(C) show respectively the case where sound attenuating is done by installing a plurality of speakers 4. FIG. 6(D) shows the case where a concave 16 for sound attenuating is formed at a part of the duct 1 and the speaker in plane shape is arranged in the concave 16.

Figure 7:
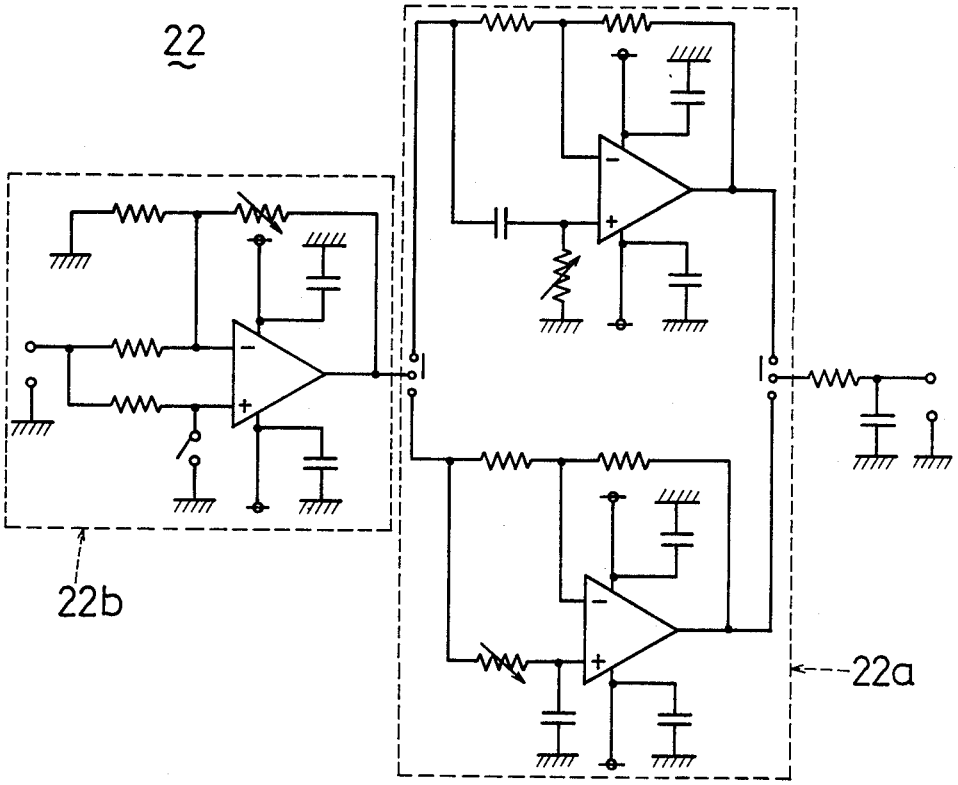
FIG. 7 is a concrete circuit diagram of a phase shift circuit.

FIG. 6(A) shows an example in which the electronic attenuator according to the present invention was applied to Jseel attenuator system. In this example, three speakers 4 are installed at regular intervals in the duct 1 in lengthwise direction of the duct (the direction in which a noise is transmitted). The control circuit 3 comprises an amplifier 21 which amplifies a sound signal from the microphone 2 and outputs to the speaker 4 at the center and a phase shift circuit 22 which outputs a reversal sound (a noise signal from the microphone 2 which was adjusted in phase and in amplitude) to the speakers 4 on both sides. FIG. 7 shows a concrete example of the phase shift circuit 22. It comprises a phase shifter 22*a* and a variable amplifier 22*b*.

Figure 8:
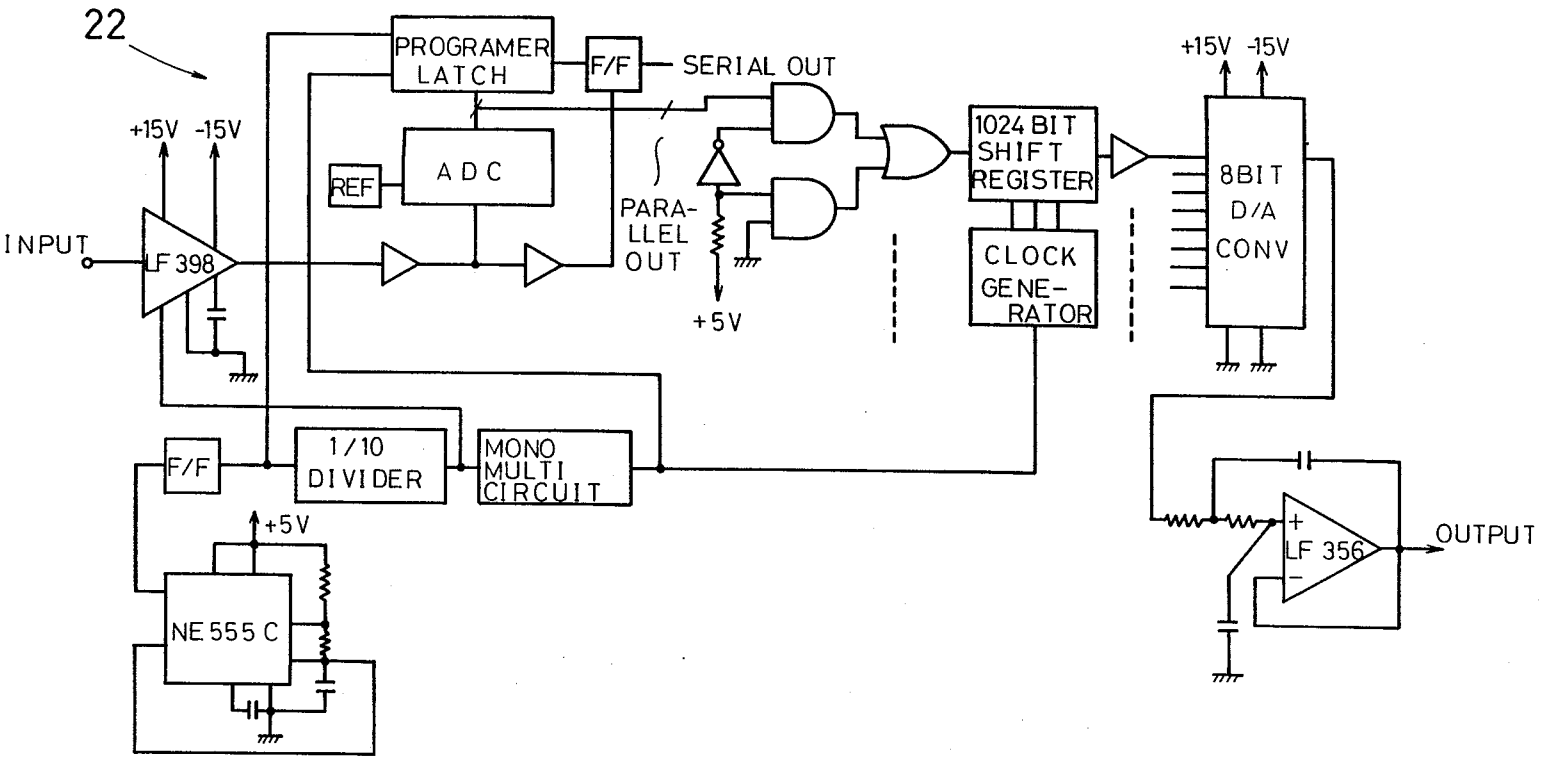
FIG. 8 and FIG. 9 are concrete circuit diagrams of delay circuit.
Figure 9:
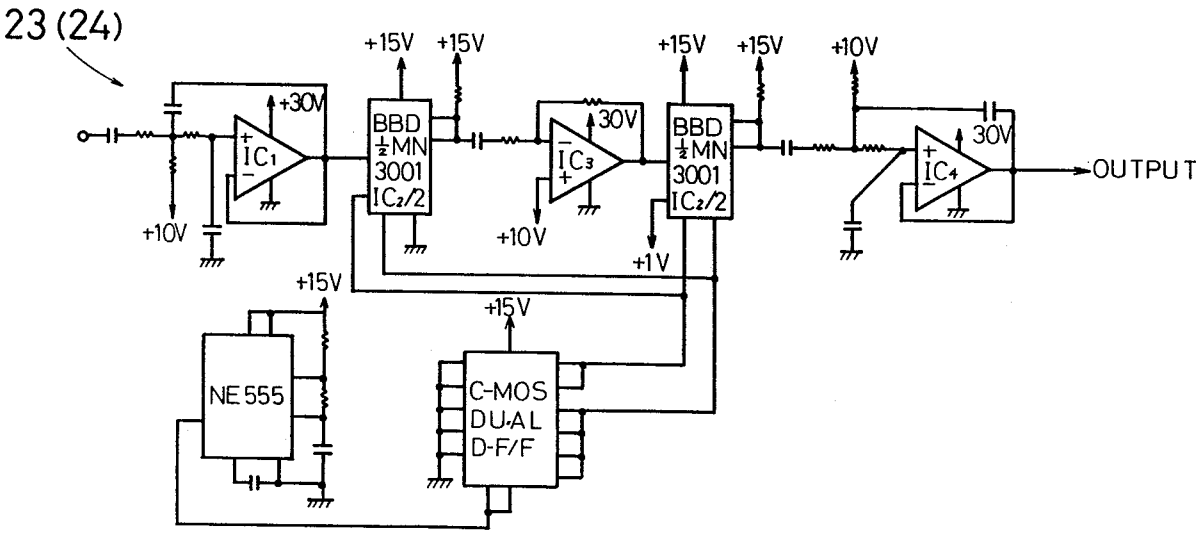

FIG. 6(B) shows an example in which the electronic attenuator of the present invention was applied to Swinbanks' attenuator system. In this example, two speakers 4 are installed in the duct 4 at the upper stream and at the downstream. The control circuit 3 comprises the first delay circuit 23 which delays a noise signal from the microphone 2 and outputs to the speaker 4 at the downstream side and the second delay circuit 24 which delays output from the first delay circuit 23 still further and outputs to the speaker 4 at the upper stream side. As concrete examples of these delay circuits 23, 24, there are an analogue delay circuit using A/D and D/A converters as shown in FIG. 8 and another analogue delay circuit using BBD (Bucket Bridge Device) as shown in FIG. 9.

FIG. 6(C) shows an example in which the electronic attenuator according to the present invention was applied to Chelsea dipole attenuator system. In this example, it is so designed that a reversal sound is generated at the control circuit 3 on the basis of a noise signal from the microphone 2 and the reversal sound thus generated is outputted to two speakers 4 installed at an equal distance from the control circuit 3.

FIG. 6(D) shows an example in which the electronic attenuator according to the present invention was applied to Monopole attenuator system.

It goes without saying that the present invention is not limited to the embodiment and the modified embodiments mentioned above but is applicable widely to apparatuses in an air conditioner, such as piping and accumulator, machines and apparatuses which generate a noise an which are other than air conditioners.

As described above, the electronic attenuator according to the present invention is so disigned that a reversal sound is emitted by the speaker 4 which is in sheet-like shape an such reversal sound is caused to interfere with a noise. Therefore, the speaker 4 can be installed, irrespective of the shape of the object in which the speaker is installed and the shape of space for installation of the speaker. In the case of the conventional attenuator, it was substantially difficult to install a speaker in a device of small scale. However, the electronic attenuator according to the present invention makes it possible to install the speaker 4 at the optimum position even in a device of small scale and has high universality, free from restrictions on the applicable object. Also, as the speaker 4 is in sheet-like shape, the space of the speaker 4 can be set freely according to installation positions and the speaker can be installed at the optimum position only by securing space required for thickness of the sheet. Thus, effective sound attenuating can be carried out as a whole. Moreover, as the present invention carries out sound attenuating by using the speaker 4 in sheet-like shape which is simpler in construction and easier to mass-produce than the conventional speaker, manufacturing costs of it are reduced and it is applicable even to a comparatively low-priced device of small scale which is liable to be restricted by cost.

The use of the speaker 4 which is curved cylindrically for the tubular noise transmittable space makes it easy to install the speaker 4 and improves interference efficiency of the reversal sound and the noise. It also improves sound attenuating effect by the increase in interference area.

Moreover, formation of the speaker 4 with a transparent driver 4*a* makes it possible to eliminate a sense of incompatibility to be caused by installation of the speaker 4.

What is claimed is:

1. An electronic attenuator comprising:

a microphone which is installed in a noise transmittable space and which detects a noise and outputs a noise signal corresonding thereto;

a control circuit which generates a reversal sound signal having a reverse phase and same sound pressure in relation to the noise on the basis of the noise signal output by said microphone; and a speaker which receives said reversal sound signal from said control circuit and emits a reversal sound to said noise transmittable space;

said speaker being disposed so as to surround said noise transmittable space and said speaker having a sheet-like shape with a driver made of a piezoelectric material.

2. An electronic attenuator comprising:

a microphone which is installed in a noise transmittable space and which detects a noise;

a control circuit which generates a reversal sound signal having a reverse phase and same sound pressure in relation to a noise on the basis of a noise signal detected by said microphone; and a speaker which receives said reversal sound signal from said control circuit and emits a reversal sound to said noise transmittable space;

said speaker having a sheet-like shape and having a driver compose of a piezoelectric material;

wherein said speaker is curved tubularly and is installed in said noise transmittable space, said noise transmittable space being cylindrical.

3. An electronic attenuator comprising:

a microphone which is installed in a noise transmittable space and which detects a noise;

a control circuit which generates a reversal sound signal having a reverse phase and same sound pressure in relation to a noise on the basis of a noise signal detected by said microphone; and a speaker which receives said reversal sound signal from said control circuit and emits a reversal sound to said noise transmittable space;

said speaker having a sheet-like shape and having a driver comprising a transparent high molecular piezoelectric material and a transparent conductive film fixed to one side thereof.

* * * * *